US006533295B2

(12) United States Patent
Gonthier

(10) Patent No.: US 6,533,295 B2
(45) Date of Patent: Mar. 18, 2003

(54) DEVICE FOR RETAINING A BOOT ON A GLIDING BOARD

(75) Inventor: Jean-Francois Gonthier, Viuz la Chiesaz (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/729,954

(22) Filed: Dec. 6, 2000

(65) Prior Publication Data

US 2001/0003394 A1 Jun. 14, 2001

(30) Foreign Application Priority Data

Dec. 13, 1999 (FR) ..... 99 15849

(51) Int. Cl.[7] ..... A63C 9/00
(52) U.S. Cl. ..... 280/14.22; 280/611
(58) Field of Search ..... 280/624, 600, 280/602, 607, 635, 11.3, 611, 618, 626, 629, 634, 636, 11.36, 14.21, 14.22, 14.24; 36/117.6; 441/70

(56) References Cited

U.S. PATENT DOCUMENTS

| | | | | | |
|---|---|---|---|---|---|
| 4,447,970 | A | * | 5/1984 | Delery | 36/121 |
| 4,821,433 | A | * | 4/1989 | Marxer | 36/121 |
| 4,897,940 | A | * | 2/1990 | Sartor | 36/119 |
| 4,945,660 | A | * | 8/1990 | Perrissoud | 36/120 |
| 5,020,823 | A | * | 6/1991 | Bogner | 280/634 |
| 5,253,894 | A | * | 10/1993 | Thomas et al. | 280/607 |
| 5,651,199 | A | * | 7/1997 | Chaigne et al. | 36/118.3 |
| 5,727,797 | A | * | 3/1998 | Bowles | 280/14.2 |
| 5,815,953 | A | * | 10/1998 | Kaufman et al. | 36/118.3 |
| 5,967,531 | A | * | 10/1999 | Saillet | 280/11.36 |
| 6,027,136 | A | * | 2/2000 | Phillips | 280/618 |
| 6,032,974 | A | * | 3/2000 | Saillet | 280/611 |
| 6,116,635 | A | * | 9/2000 | Rigal | 280/618 |
| 6,206,403 | B1 | * | 3/2001 | Black et al. | 280/618 |
| 6,231,057 | B1 | * | 5/2001 | Reuss et al. | 280/14.21 |
| 6,237,450 | B1 | * | 8/2001 | Challande et al. | 280/624 |
| 6,283,492 | B1 | | 9/2001 | Hale | 280/611 |

FOREIGN PATENT DOCUMENTS

| | | | |
|---|---|---|---|
| EP | 0056774 | * | 7/1982 |
| EP | 0242526 | * | 10/1987 |
| EP | 0797936 | * | 10/1997 |
| EP | 0933100 | * | 8/1999 |
| WO | WO97/28858 | * | 8/1997 |
| WO | WO98/47398 | * | 10/1998 |

OTHER PUBLICATIONS

U.S. patent application Publication No. 2002/0027335 A1 (Hale), published on Mar. 7, 2002.

* cited by examiner

*Primary Examiner*—Paul N. Dickson
*Assistant Examiner*—Laura B. Rosenberg
(74) *Attorney, Agent, or Firm*—Greenblum & Bernstein, P.L.C.

(57) ABSTRACT

A device for retaining a boot on a gliding board, such as a snowboard. The device includes a base and a rear support element, the latter being journalled on the base along a substantially transverse Y–Y' axis of the device. An abutment limits a rotation of the rear support element along the Y–Y' axis in a front-to-rear direction. An elastic mechanism is provided to bias the rear support element in a rear-to-front direction, over a short range, from the rear position.

20 Claims, 3 Drawing Sheets

DEVICE FOR RETAINING A BOOT ON A GLIDING BOARD

BACKGROUND OF THE INVENTION

1. Field of the Invention

The present invention relates to the field of devices for retaining a boot on a gliding board, and relates more particularly to a device for a snowboard.

2. Description of Background and Relevant Information

Some of the previously known boot-retention devices are provided to retain a flexible boot onto the gliding board and have the following structure.

Such device includes a base and a rear support element, the base having a seat that extends between a front end and a rear end along a longitudinal direction of the device, the base having two lateral edges affixed to the seat, th edges being connected to one another on the side of the rear end of the seat by an arch, the rear support element being journalled on the base along a substantially transverse journal awls of the device. The boot is retained on the device, for example, by means of straps.

On this type of device, the rear support element, which extends upon contact with the boot at the level of the user's lower leg, generally has a substantial rigidity so that steering is precise Indeed, a substantially rigid rear support element enables a direct transmission of the steering impulses to the board.

A disadvantage associated with this rigidity is that the impacts to which the board is subject, while being operated, are reflected in the user's leg. This phenomenon occurs during rear supports, i.e., when the user presses with the lower leg against the rear support element. As a result, the user sometime feels a pain in the lower leg.

SUMMARY OF THE INVENTION

An object of the invention is particularly to provide a device for retaining a flexible boot upon a gliding board, such as a snowboard, which enables precise steering, and which reduces the repercussion in the lower leg of an impact to which the board has been subject.

To this end, a device for retaining a boot on a gliding board according to the invention particularly includes a base adapted to receive at least a portion of the boot sole and a rear support element provided to ensure rear support of the lower leg, the rear support element being journalled on the base along a substantially transverse Y–Y' axis of the device, an abutment being provided to limit a rotation of the rear support element along the Y–Y' axis in a front-to-rear direction, the position occupied by the rear support element, when the front-to-rear rotation is maximum, being a rear or rearwardmost position.

In the device of the invention, an elastic mechanism is provided to bias the rear support element in a rear-to-front direction, over a short range, from the rear position.

During rear support with the lower leg, the rigidity of the rear support element generates a nominal deformation of the elastic mechanism. This means that for a usual support of the lower leg on the rear, or dorsal, support element during steering, the elastic mechanism is subject to a given reversible deformation, and transmits the user's supporting forces to the board.

However, if an impact occurs on the board, i.e., if a brief and substantial force is applied to the board, the elastic mechanism then undergoes an additional deformation to absorb the energy resulting from the impact.

As a result, the impact is not, or is not completely reflected in the user's leg. The elastic mechanism plays the role of a shock absorber. An advantage is that the steering of the board is more comfortable while also being substantially precise.

BRIEF DESCRIPTION OF DRAWINGS

Other characteristics and advantages of the invention will be better understood from the description that follows, with reference to the annexed drawings showing, by way of a non-limiting example, how the invention can be embodied, and in which.

DETAILED DESCRIPTION OF THE INVENTION

An exemplary embodiment of the invention is described hereinafter with reference to FIGS. 1–6.

Figure 1:
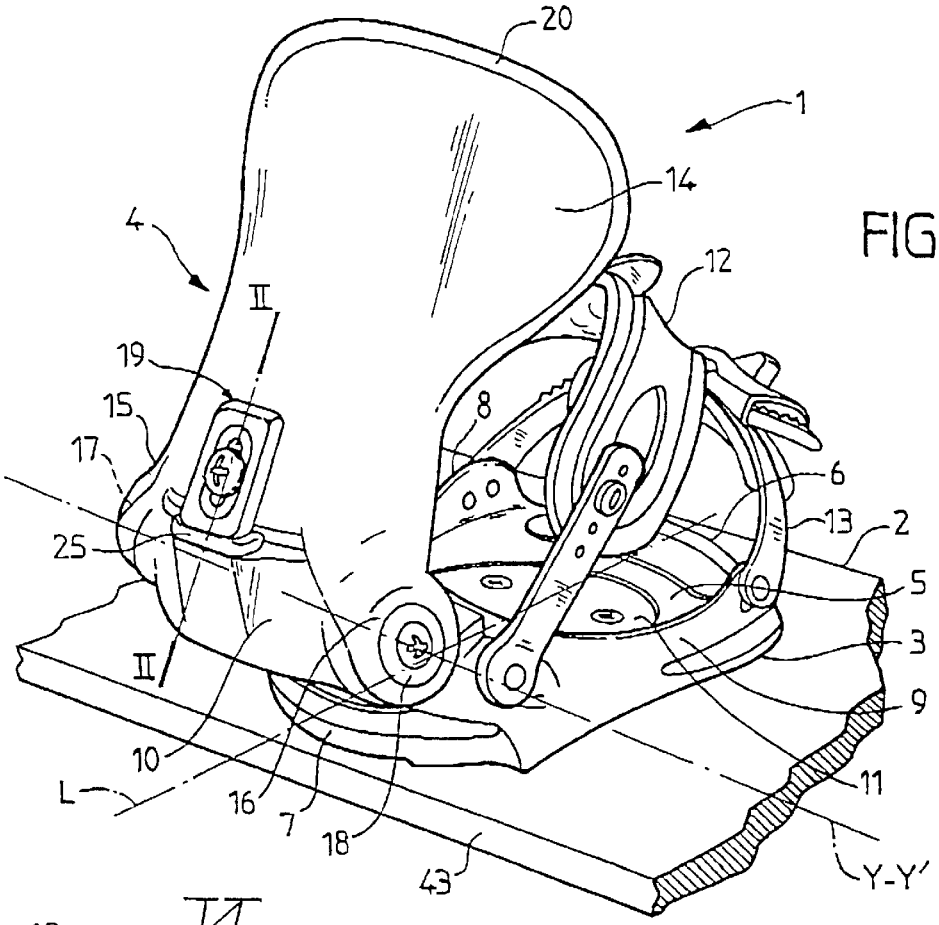
FIG. 1 is a rear perspective view of a retaining device according to the invention.

In a known manner, as is understood, for example, by means of FIG. 1, a device 1 is provided to retain a boot on a gliding board 2, the boot not being shown for reasons of convenience.

The device 1 includes a base 3 and a rear support element 4. The base 3 has a seat 5, that extends between a front end 6 and a rear end 7 along a longitudinal direction L of the device 1, for supporting the sole of the boot.

It is to be understood that the longitudinal direction L of the device 1 is a direction that is substantially the same as the longitudinal direction of the boot when the latter is retained on the device 1.

The base 3 has a first lateral edge 8 and second lateral edge 9 that are provided to retain the boot along a transverse direction of the device 1. It is to be understood that the transverse direction is a direction that is substantially perpendicular to the longitudinal direction L, and substantially parallel to the seat 5.

An arch 10 connects the edges 8, 9 on the side of the rear end 7 of the seat 5. The arch 10 is an edge that is located toward the rear of the device 1, raised with respect to the seat 5. That is, as shown in FIGS. 1 and 4–6, the arch 10 of the boot retention device 1 is spaced above the seat 5.

Preferably, the seat 5, the edges 8, 9, and the arch 10 form an integral piece, with the arch fixed in position relative to the edges during use of the device, which integral relationship enables the base 3 to be manufactured according to a simple process. For example, the base 3 can be made with a plastic or metallic material introduced in a mold, such as polyamide reinforced with glass fibers.

The base 3 is retained on the board 2 by any means known to the person with ordinary skill in the art, such as a disk 11, for example, which is itself affixed to the board 2 by any suitable means.

The boot is removably retained on the base 3 by a means shown in the form of straps 12, 13, which are also well known to persons with ordinary skill in the art.

The straps 12, 13 hold the boot such that the sole lays flat on the seat 5, and that the heel lays flat on the arch 10 or is located in the vicinity of the latter.

The rear support element 4 has an incurved portion 14, as well as a first arm 15 and a second arm 16 located in the extension of the lateral edges 8, 9, respectively. The rear support element 4 is journalled on the arch 10 along a substantially transverse Y–Y' axis of the device 1.

It is to be understood that the Y–Y' axis is oriented in the transverse direction of the device 1.

The journal of the rear support element 4 on the arch 10 is obtained by a means shown in the form of a first screw 17 and second screw 18 each oriented substantially along the Y–Y' axis, which corresponds to a technique well known to the person with ordinary skill in the art. The first screw 17 is arranged in the area of the first arm 15, and the second screw 18 is arranged in the area of the second arm 16.

An adjustable abutment 19 limits a front-to-rear journal movement, along the Y–Y' axis, of the rear support element 4 with respect to the base 3. The front-to-rear journal movement is to be understood as being a movement during which an upper end 20 of the rear support element 4 moves away from the front end 6 of the seat 5.

A rear-to-front movement is an inverse movement.

Figure 2:
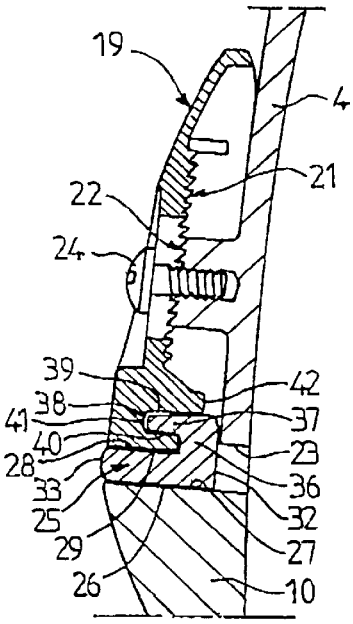
FIG. 2 is a cross-section along the line II—II of FIG. 1.

The abutment 19 is shown in cross-section in FIG. 2. The abutment 19 has a toothed sector 21 provided to cooperate with a toothed sector 22 affixed to the rear support element 4, such that the abutment 19 is attached on the rear support element 4 in a selected position.

It is possible to move the abutment 19 closer to or away from a lower end 23 of the rear support element 4 by displacing the sectors 21, 22, one with respect to the other. To this end, it suffices to loosen a screw 24 for holding the abutment 19 on the rear support element 4, to position the sectors 21, 22, with respect to one another, then to tighten the screw 24.

According to the invention, an elastic mechanism is arranged in the area of the abutment 19 to bias the rear support element 4 in the rear-to-front direction. The bias occurs over a short range from a rear or rearwardmost position, which is a position occupied by the rear support element 4 when the rotation in the front-to-rear direction is maximum. This phenomenon is explained below.

As seen in FIGS. 1 and 2, the elastic mechanism is shown in the form of a wedge or spacer 25 attached on the abutment 19, the wedge 25 being made of a deformable material in a reversible manner, i.e., an elastically deformable material. For example, the wedge 25 can be made of rubber, polypropylene, silicone, or any other suitable material. The hardness of the constituent material of the wedge 25 is preferably close to 80 Shore A.

The wedge 25 has a lower surface 26 provided to rest on an upper surface 27 of the arch 10, as well as an upper surface 28 provided to rest against a lower surface 29 of the abutment 19.

Figure 3:
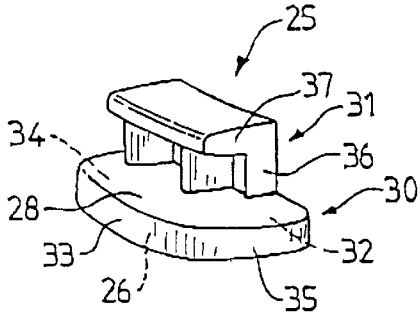
FIG. 3 is a perspective view of a detail of FIG. 1.

The structure of the wedge 25, considered as such, is shown in FIG. 3.

The wedge 25 is an integral piece that includes a working zone 30, as well as an affixation zone 31.

The working zone 30 is demarcated in thickness by the upper surface 28 and lower surface 26, in length by a front surface 32 and a rear surface 33, and in width by a first surface 34 and a second surface 35. For example, the thickness can be comprised between 3 and 12 mm, the length between 8 and 18 mm, and the width between 15 and 50 mm. As will be better understood subsequently, the working zone 30 can be compressed between the abutment 19 and the arch 10.

The affixation zone 31 is provided to affix the wedge 25 to the abutment 19. The affixation zone 31 is a portion of the wedge 25 that projects with respect to the upper surface 28. The affixation zone 31 is related to a hook that includes a core 36 and a foot 37.

As shown in FIG. 2, a groove 38 is provided in the abutment 19 to receive the foot 37 of the wedge 25. This groove is demarcated especially by an upper surface 39, a lower surface 40, and a bottom 41. The groove 38 is formed on a surface 42 of the abutment 19 at least a portion of which is opposite the rear support element 4.

The assembly of the wedge 25 with the abutment 19 is done by snap engagement of the foot 37 into the groove 38. Preferably, the foot 37 and the groove 38 have dimensions that enable the foot 37 to be retained in the groove 38. Thus, when the user adjusts the position of the abutment 19 with respect to the rear support element 4, as has been explained previously, the wedge 25 remains affixed to the abutment 19.

This means that it is possible to move the abutment 19 away from the rear support element 4 without losing the wedge 25.

When the abutment 19 is in place on the rear support element 4, the latter improves the retention of the wedge 25 on the abutment 19, because it prevents or limits the exit of the foot 37 from the groove 38.

The functioning of the device 1 is explained hereinafter with reference to FIGS. 4–6.

Figure 4:
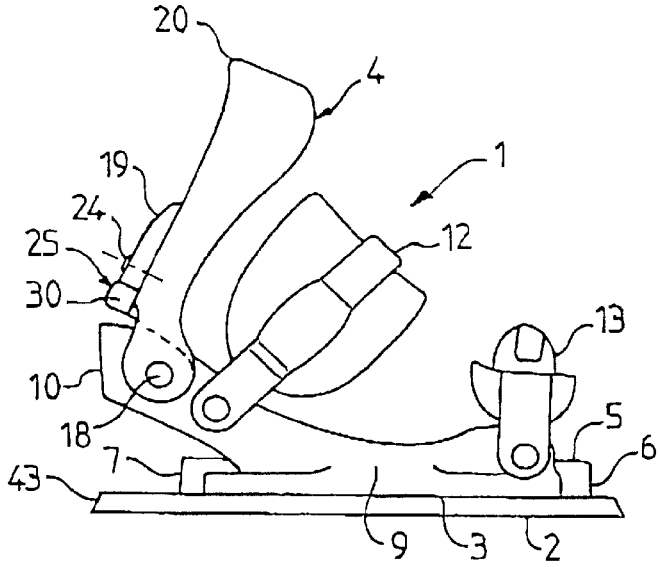
FIG. 4 is a lateral schematic view of the device of FIG. 1, for a given situation of the device.

The device 1 is shown in FIG. 4 in a situation where the boot is not supported on the rear support element 4. The latter is in any angular position with respect to the base 3. As a result, the wedge 25 is not in contact with the arch 10.

Figure 5:
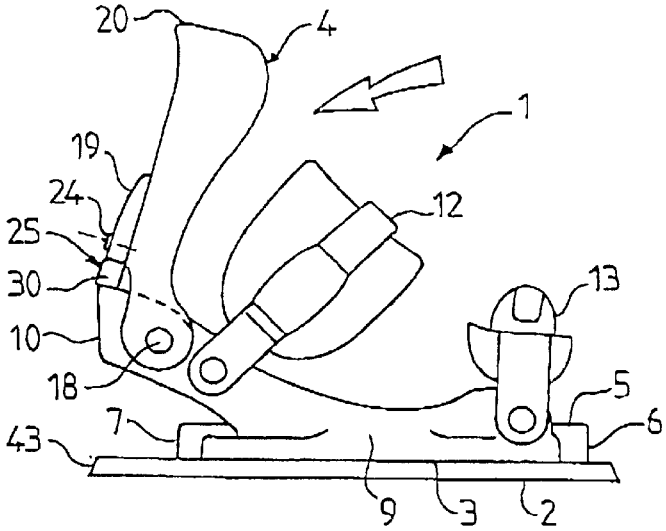
FIG. 5 is a view similar to FIG. 4, but corresponds to another situation.

In the situation shown in FIG. 5, the rear support element 4 is oriented such that the wedge 25 is in contact with the arch 10.

This situation corresponds to a usual steering position of the board 2. The user takes rear supports along the direction of the arrow, i.e., by pressing on the rear support element 4 in a front-to-rear direction. The wedge 25 enables a dampening of support forces.

Figure 6:
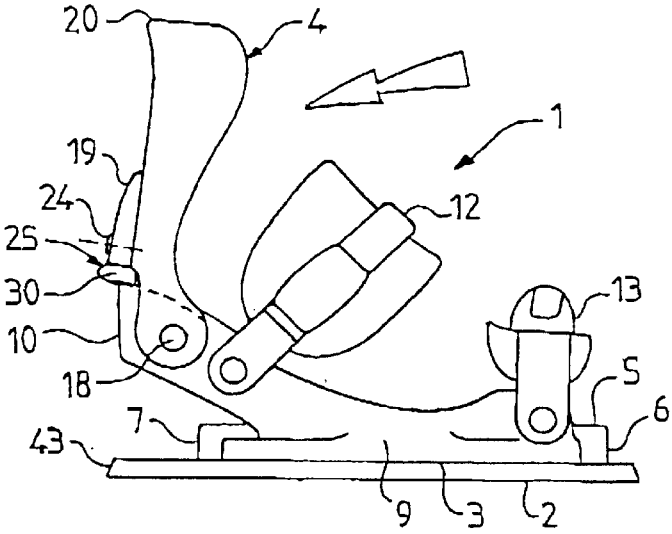
FIG. 6 is a view similar to FIGS. 4 and 5, but corresponds to yet another situation.
Figure 7:
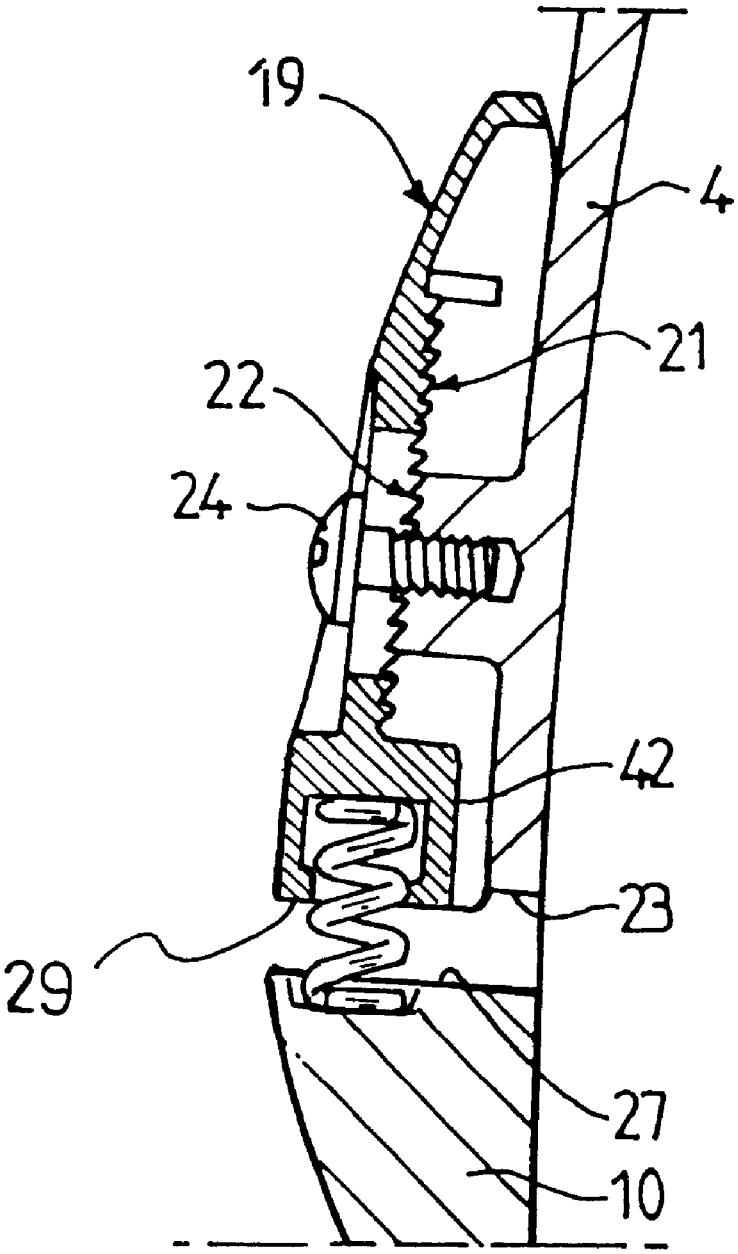
FIG. 7 schematically illustrates an alternate embodiment of the invention.

If a supplemental force is exerted on the rear support element 4, as is the case along the arrow in FIG. 6, the wedge 25 is more substantially compressed.

This situation can occur, for example, at the time an impulse is given to perform a jump, during a jump landing, by impact of the board 2 on a rock hidden in the snow, or the like. The supplemental force induces an additional, temporary deformation of the wedge 25, the deformation enabling a dissipation of the energy generated during the jump or during impact.

In other words, it can be said that the wedge 25 absorbs certain impacts or certain impulses.

An advantage associated with the presence of the wedge 25 on the device 1 is the increased steering comfort.

The working zone 30 of the wedge 25 cannot be compressed beyond a certain limit associated with the characteristics of the constituent material of the wedge 25. When the working zone 30 is in its maximum compression state, the rear support element 4 is in the previously mentioned rear or rearwardmost position. The abutment 19 then limits the rotation of the rear support element 4 in the front-to-rear direction. The compression of the working zone 30 occurs over a short range, i.e., over several millimeters.

To reassume the position shown in FIG. 5, the rear support element 4 is biased by the constituent material of the wedge 25. The working zone 30 tends to recover the thickness which it has in the absence of forces or during the usual forces.

When the wedge 25 has reassumed its initial shape, it no longer biases the rear support element 4 in the rear-to-front direction.

The invention is not limited to the particular embodiment described hereinabove, and includes all of the technical equivalents that fall within the scope of the following claims.

In particular, other embodiments of the wedge, or other means for affixing the wedge to the abutment can be provided. For example, adhesive or duplicate molding could be used.

Furthermore, one can provide the wedge to be affixed to the arch, the abutment remaining affixed to the rear support element.

One could also provide that both the abutment and wedge be axed to the arch.

Furthermore, wedge and abutment structures can be provided such that the deformable material of the wedge is biased in traction, in shearing, or the like.

Still, it can be provided that the elastic mechanism is not a deformable wedge but a spring.

In this case, the spring could be positioned in the same area as the wedge, or somewhere else. A non-limiting example consists of housing the helical spring in an oblong hole of the abutment, such that the abutment can move elastically to dampen impacts.

The instant application is based upon the French Patent Application No. 99 15849, filed Dec. 13, 1999, the disclosure of which is hereby incorporated by reference thereto in its entirety, and the priority of which is hereby claimed under 35 U.S.C. §119.

What is claimed is:

1. A device for retaining a boot on a gliding board, the device comprising:

a base adapted to receive at least a portion of the boot sole and a rear support element provided to ensure rear support of the lower leg of a user, the base including a seat for supporting the boot and a pair of transversely spaced apart lateral edges, an arch connecting the pair of lateral edges of the base in a fixed position relative to the pair of lateral edges of the base during use of the device, the arch being spaced above the seat of the base, the rear support element being journalled on the base along a substantially transverse Y–Y' axis of the device, an abutment being provided to limit a rotation of the rear support element along the Y–Y' axis in a front-to-rear direction, the position occupied by the rear support element, when the front-to-rear rotation is maximum, being a rear position, an elastic mechanism being provided to bias the rear support element in a rear-to-front direction, over a short range, from the rear position.

2. A retaining device according to claim 1, wherein the elastic mechanism is a spring.

3. A device for retaining a boot on a gliding board, the device comprising:

a base adapted to receive at least a portion of the boot sole and a rear support element provided to ensure rear support of the lower leg of a user, the base including a seat for supporting the boot and a pair of transversely spaced apart lateral edges, an arch connecting the pair of lateral edges of the base, the arch being spaced above the seat of the base, the rear support element being journalled on the base along a substantially transverse Y–Y' axis of the device, an abutment being provided to limit a rotation of the rear support element along the Y–Y' axis in a front-to-rear direction, the position occupied by the rear support element, when the front-to-rear rotation is maximum, being a rear position, an elastic mechanism being provided to bias the rear support element in a rear-to-front direction, over a short range, from the rear position, the elastic mechanism comprising a wedge made of an elastically deformable material, the wedge being affixed to the abutment.

4. A retaining device according to claim 3, wherein the abutment is affixed to the rear support element, such that at least a portion of the wedge can be compressed between the arch and the abutment when the rear support element is biased in the front-to-rear direction.

5. A retaining device according to claim 3, wherein the wedge has a compression zone and a zone for affixing to the abutment.

6. A retaining device according to claim 5, wherein the zone for affixing the wedge has a core and a foot, and wherein the abutment has a groove provided to receive the foot.

7. A retaining device according to claim 6, wherein the groove is formed on a surface of the abutment, at least a portion of which is opposite the rear support element.

8. A retaining device according to claim 3, wherein the wedge is made of a material including polypropylene.

9. A device for retaining a boot on a gliding board, the device comprising:

a base adapted to receive at least a portion of the boot sole and a rear support element provided to ensure rear support of the lower leg of a user, the rear support element being journalled on the base along a substantially transverse Y–Y' axis of the device, an abutment being provided to limit a rotation of the rear support element along the Y–Y' axis in a front-to-rear direction by cooperation with a fixed part of the device, the position occupied by the rear support element, when the front-to-rear rotation is maximum, being a rear position, an elastic mechanism being provided to bias the rear support element in a rear-to-front direction, over a short range, from the rear position, said base further comprising a seat for supporting the boot and a pair of transversely spaced apart lateral edges, wherein an arch connects the pair of lateral edges of the base in a fixed position relative to the pair of lateral edges of the base during use of the device, and the fixed part of the device for cooperation with the abutment being a part of the arch.

10. A snowboard boot-retention device, said snowboard boot-retention device comprising:

a base comprising a seat to support a sole of a rider's boot, said base further comprising a pair of transversely spaced apart upwardly extending lateral edges and an arch extending upwardly with respect to said seat and extending between and being fixedly positioned relative to said lateral edges during use of the device, said arch to be positioned rearwardly of the rider's boot;

a rear support element to be positioned rearwardly of the rider's boot, said rear support element being mounted to said base for front-to-rear and rear-to-front movement, said front-to-rear movement extending to a rearwardmost position; and an elastic mechanism to exert an elastic force to said rear support element in a forward direction from said rearwardmost position over a predeterminate range of movement.

11. A snowboard boot-retention device according to claim 10, wherein:

said arch is spaced above and rearward of said seat of said base.

12. A snowboard boot-retention device according to claim 10, wherein:

said elastic mechanism is a helical spring.

13. A snowboard boot-retention device according to claim 10, wherein:

said elastic mechanism is a single piece of material.

14. A snowboard boot-retention device, said snowboard boot-retention device comprising:

a base comprising a seat to support a sole of a rider's boot, said base further comprising a pair of transversely spaced apart upwardly extending lateral edges and an arch extending upwardly with respect to said seat and extending between said lateral edges, said arch to be positioned rearwardly of the rider's boot;

a rear support element to be positioned rearwardly of the rider's boot, said rear support element being mounted to said base for front-to-rear and rear-to-front movement, said front-to-rear movement extending to a rearwardmost position; and an elastic mechanism to exert an elastic force to said rear support element in a forward direction from said rearwardmost position over a predeterminate range of movement between 3 and 12 millimeters.

15. A snowboard boot-retention device, said snowboard boot-retention device comprising:

a base comprising a seat to support a sole of a rider's boot, said base further comprising a pair of transversely spaced apart upwardly extending lateral edges and an arch extending upwardly with respect to said seat and extending between said lateral edges, said arch to be positioned rearwardly of the rider's boot;

a rear support element to be positioned rearwardly of the rider's boot, said rear support element being mounted to said base for front-to-rear and rear-to-front movement, said front-to-rear movement extending to a rearwardmost position;

an abutment for cooperation with a fixed part of said base, and an adjustable mounting for adjustably mounting said abutment to said rear support element for establishing said rearwardmost position of said rear support element; and an elastic mechanism attached to said abutment to exert an elastic force to said rear support element in a forward direction from said rearwardmost position over a predeterminate range of movement.

16. A snowboard boot-retention device according to claim 15, wherein:

said fixed part of said base is said arch.

17. A snowboard boot-retention device according to claim 15, wherein:

said elastic mechanism comprises a spacer comprising an elastically deformable material, said spacer comprising an affixation zone and a working zone, said affixation zone of said spacer having a thickness for attaching said spacer to said abutment, and said working zone of said spacer having a thickness for elastic deformation.

18. A snowboard boot-retention device according to claim 17, wherein:

said thickness of said working zone of said spacer is between 3 and 12 millimeters.

19. A snowboard boot-retention device according to claim 17, wherein:

said working zone of said spacer is an elastically compressible zone.

20. A snowboard boot-retention device, said snowboard boot-retention device comprising:

a base comprising a seat to support a sole of a rider's boot, said base further comprising a pair of transversely spaced apart upwardly extending lateral edges and an arch extending upwardly with respect to said seat and extending between said lateral edges, said arch to be positioned rearwardly of the rider's boot;

a rear support element to be positioned rearwardly of the rider's boot, said rear support element being mounted to said base for front-to-rear and rear-to-front movement, said front-to-rear movement extending to a rearwardmost position;

an abutment for cooperation with said arch, and an adjustable mounting for adjustably mounting said abutment to said rear support element for establishing said rearwardmost position of said rear support element; and an elastic mechanism comprising an elastically compressible material attached to said abutment for compression between said abutment and said arch in said rearwardmost position of said rear support element to exert an elastic force to said rear support element in a forward direction from said rearwardmost position over a predeterminate range of movement.

* * * * *